United States Patent [19]

DeViaris

[11] Patent Number: 4,821,845

[45] Date of Patent: Apr. 18, 1989

[54] TRAVERSING ELEVATOR

[75] Inventor: Guy DeViaris, Neuilly, France

[73] Assignee: Otis Elevator Company, Farmington, Conn.

[21] Appl. No.: 132,549

[22] PCT Filed: Feb. 5, 1986

[86] PCT No.: PCT/US86/00255

§ 371 Date: May 23, 1986

§ 102(e) Date: May 23, 1986

[87] PCT Pub. No.: WO86/04569

PCT Pub. Date: Aug. 14, 1986

[30] Foreign Application Priority Data

Feb. 5, 1985 [FR] France ..... 85 01567

[51] Int. Cl.[4] ..... B66B 9/06

[52] U.S. Cl. ..... 187/12; 182/141; 212/206

[58] Field of Search ..... 187/12, 6, 7; 182/82, 182/141, 148, 45, 187; 414/591; 212/205, 206, 218

[56] References Cited

U.S. PATENT DOCUMENTS

| | | | |
|---|---|---|---|
| 1,473,813 | 11/1923 | Crispen | 187/12 |
| 4,235,305 | 11/1980 | Nygren | 187/6 |
| 4,257,491 | 3/1981 | Presnall, Jr. et al. | 187/6 |

FOREIGN PATENT DOCUMENTS

| | | |
|---|---|---|
| 2314120 | 3/1973 | Fed. Rep. of Germany . |
| 3032032 | 4/1982 | Fed. Rep. of Germany . |
| 2131760 | 6/1984 | United Kingdom . |

*Primary Examiner*—Joseph J. Rolla
*Assistant Examiner*—Kenneth Noland

[57] ABSTRACT

A traversing elevator is provided comprising a cabin (1) moving over a supporting structure (3) astride a traffic way (9) and clearing an obstacle (12). Movement of the cabin is provided by means of roller trollys (17) and lower rollers (21) fixed to the cabin and running over supporting rails. The cabin is held horizontal all along its travel path.

17 Claims, 3 Drawing Sheets

TRAVERSING ELEVATOR

TECHNICAL FIELD OF THE INVENTION

The present invention relates to a traversing elevator for ferrying pedestrians easily and safely across streets.

BACKGROUND OF THE INVENTION

Crossing town streets with heavy traffic can be difficult and dangerous for pedestrians. High traffic flow, vehicles passing at high speed after running red lights, and pedestrians crossing the street without waiting for the green light are just a few of the hazards involved. Crossing railroads, waterways, work sites or other obstacles also can be dangerous.

Arc elevators that allow pedestrians to cross obstacles are known. An arcuate supporting structure straddles the obstacle and the cabin is suspended like a pendulum from the supporting structure. This form of suspension produces uncomfortable pendulum-like movements of the elevator cabin, due to wind, acceleration, and passenger movement.

Furthermore, the swinging cabin may be struck by vehicles whose height exceeds an authorized maximum, and when the cabin is suspended below the supporting structure the height of the supporting structure is increased.

DISCLOSURE OF THE INVENTION

The object of the present invention is to provide a traversing elevator for ferrying pedestrians over town streets, railroads, water ways, work sites or other obstacles, without the aforementioned disadvantages.

According to the invention, a traversing elevator, of the type shuttling back and forth over a supporting structure in the form of an arc astride said track or obstacle to be crossed, comprises at least one cabin and at least one station accessible to the pedestrians. The movement of the cabin is provided by a cable traction device with electric motor propulsion, and the cabin is guided vertically and horizontally by tracks.

According to one aspect of the invention, four roller trolleys are situated substantially at the ends of the angles of intersection of the cabin in a substantially median horizontal plane thereof, these trolleys being pivotably fixed to the cabin with their pivoting axes merged in pairs.

According to another aspect of the invention, two lower roller assemblies are situated under the cabin and disposed substantially in the two vertical planes of the pivoting axes of said trolleys, these roller assemblies being secured to the cabin by fixing triangles.

According to another aspect of the invention, an element for guiding the roller trolleys when traveling is integral with the supporting structure and formed on one side of the structure by an outer rail receiving the downstream roller trolleys and an inner rail integral with a check rail, receiving the upstream roller trolleys, these rails comprising successively a vertical rising part extending from said station and a part with transmission curvature, the outer rail being connected at its upper end to the check rail and the inner rail being extended as far as the second station.

According to another aspect of the invention, at least one take-up cam is disposed at the bottom of the beam of the supporting structure and projecting over a small length outwardly of the arc of the beam, said cam being adapted for receiving said take up rollers when running, so as to support the cabin when the downstream roller trolleys leave the upper end of the outer rail.

According to another aspect of the invention, the downstream roller trolley runs on the outer rail. The traction cables return the lower upstream rollers to their running rail, so that the axis of the lower rollers cannot deviate from the line of curvature of this rail. The triangle defined by said three points defines the movement of the cabin which is determined by two points with fixed paths (those of the axes of the upstream roller trolleys and of the axes of the lower rollers). This triangle moves in parallel relation over the arc portions of the rails and follows the transition curvature line of the arcs.

BEST MODE FOR CARRYING OUT THE INVENTION

Figure 1:
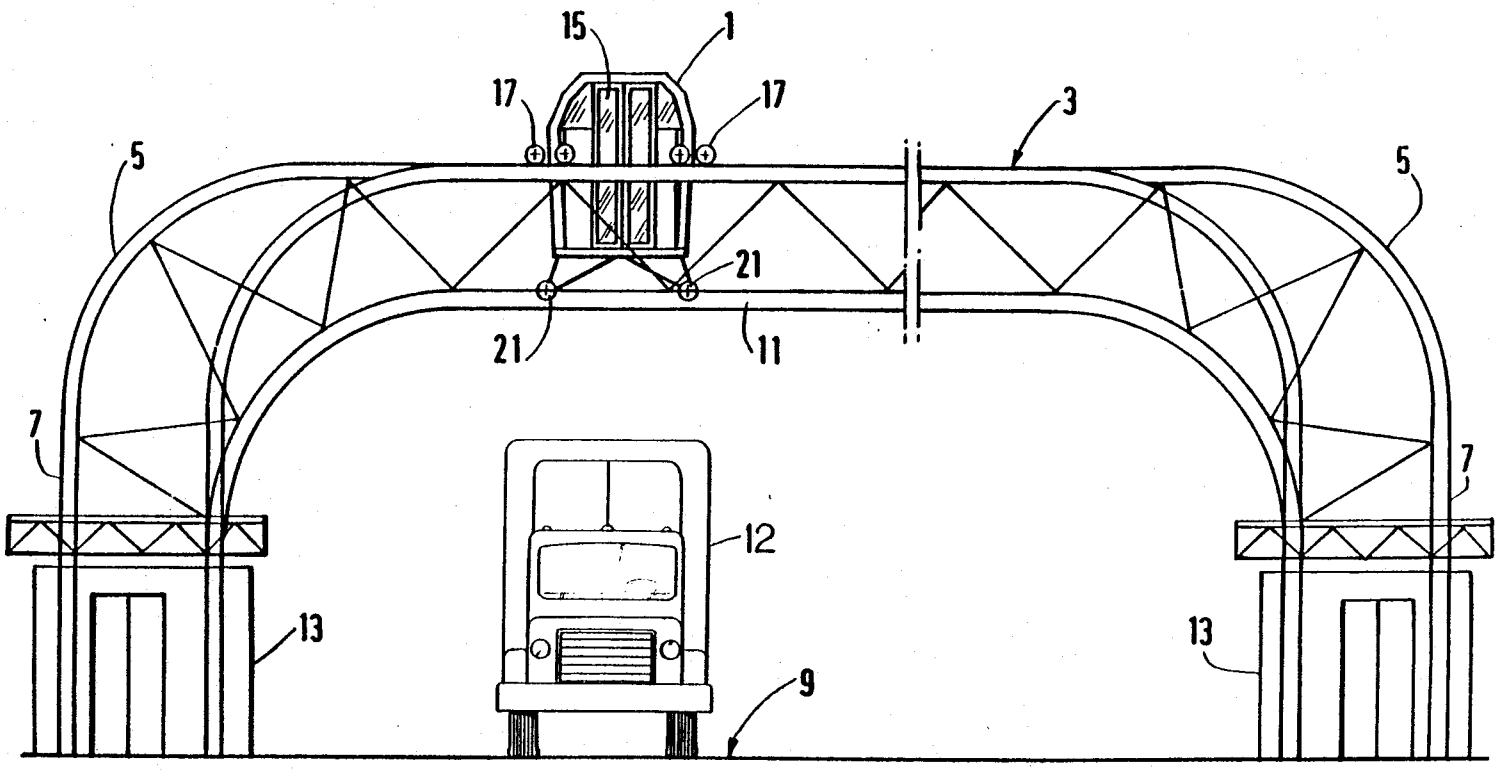
FIG. 1 is a schematical elevational view of a traversing elevator in accordance with the invention.

As shown in FIG. 1, an elevator cabin (cab car) 1 travels over a supporting structure 3 comprising two lateral arc portions 5 supported by two vertical upright portions 7. The supporting structure 3 straddles a thoroughfare 9 along a main horizontal and rectilinear portion 11. The under beam height of the supporting structure is about 5.5 m. This height is sufficient in most cases to clear obstacles 12 on the thoroughfare. The lateral arc portions 5 have a circular curvature whose radius is close to 3 m.

At the base of each of the upright portions 7 of the supporting structure is situated a station 13 for the entrance and exit of passengers. The elevator cabin moving from one station to the other ferries the passengers easily and safely over the thoroughfare.

Figure 3:
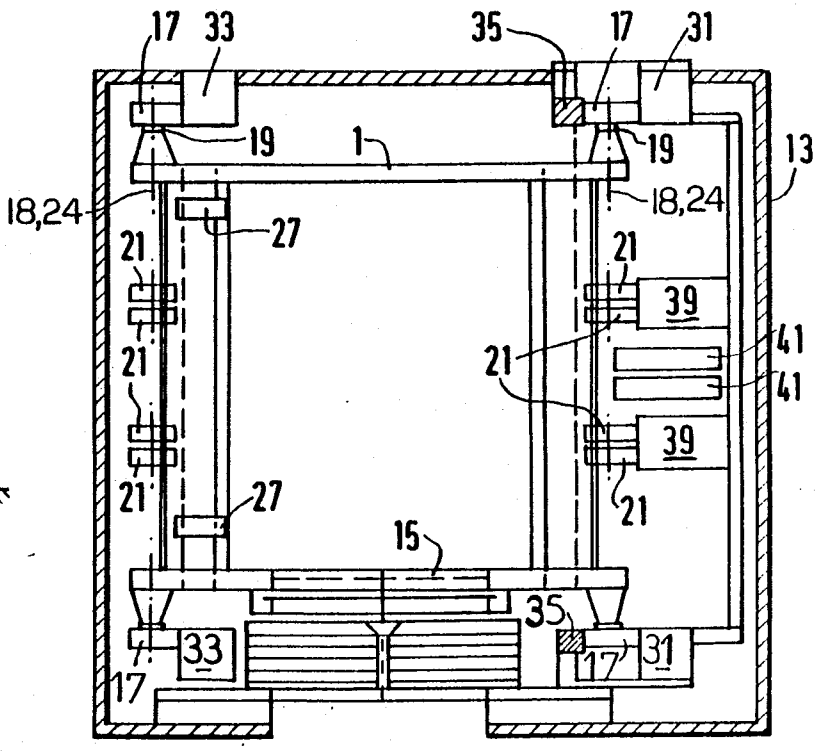
FIG. 3 is a sectional view of this elevator cabin along the line III—III of FIG. 2.
Figure 2:
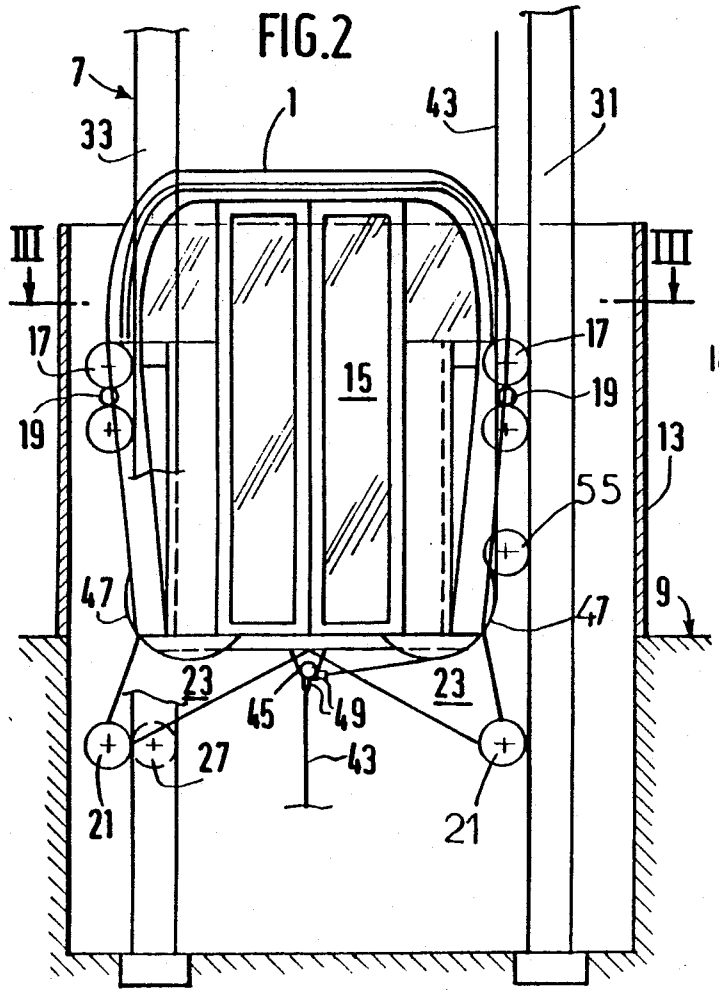
FIG. 2 is an elevational view of an elevator cabin in accordance with the invention.
Figure 4:
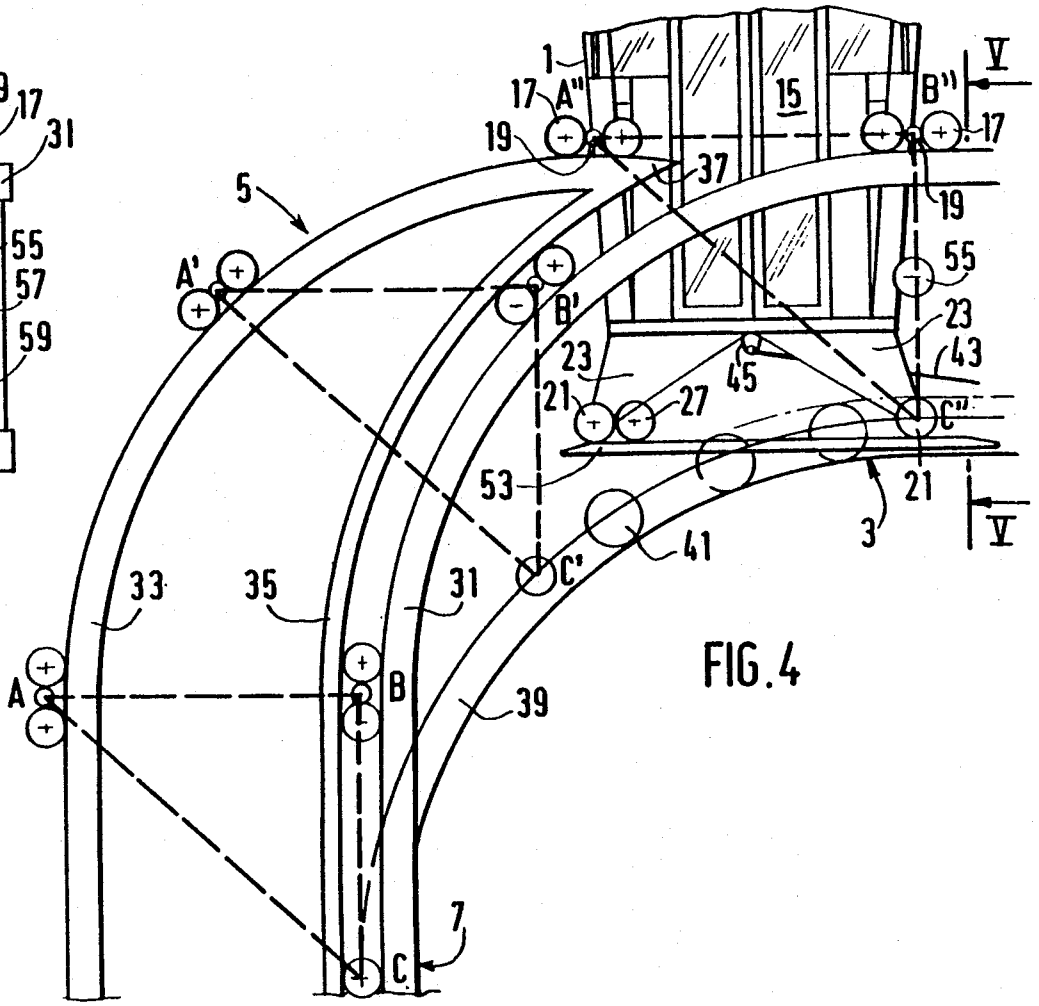
FIG. 4 is a partial view of an arc of the supporting structure illustrating the movement of the elevator cabin.
Figure 5:
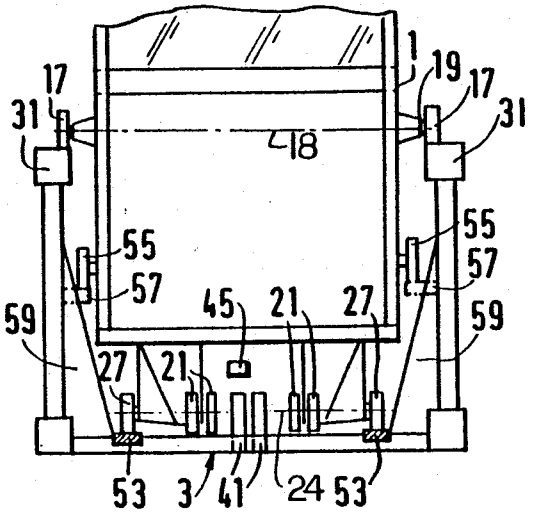
FIG. 5 is a partial-sectional view along line V—V of FIG. 4.

FIG. 2 shows the elevator cabin 1 at a station 13. This cabin is made from a light metal with a plastic material dome and sliding doors 15, and has, in its middle part, four roller trolleys 17 or bogies situated in the vicinity of its edges (see FIG. 3). These bogies 17 are pivotally mounted to the cabin along parallel axes 18 in the same horizontal plane. At the lower level of the cabin, lower rollers 21 are disposed in pairs. The lower rollers 21 are fixed to the cabin by triangular brackets 23 connected to the cabin. The axes 24 of the lower roller pairs are parallel to those of bogies 17 and horizontal plane beneath the plane of the axes 18. In addition, the axes of the lower rollers are situated two-by-two in vertical planes passing thorugh the axes 18 of the bogies 17. In the horizontal plane of the axes 24 are also situated take up rollers 27 with axis parallel to those of the bogies 17 and lower rollers 21. The rollers of bogies 17, the lower rollers 21 and the take-up rollers 27 have the same diameter. The upstream bogies 17 and the downstream bogies 17 run respectively on inner 31 and outer 33 rails, fixed to the supporting structure 3. The upstream bogies 17 are further retained (FIG. 3) by a check rail 35 connected by its upper end 37 to the outer rail 33 (FIG. 4). The lower rollers 21 also run on two rails 39 disposed on each side of the line of pulleys 41 of the traction cables 43. These latter are connected to the cabin by an attachment point 45 fixed under the cabin in its vertical median axis. They bear on a rounded sector 47 at the base of the cabin and return the lower rollers 21 to their running rails 39. These cables 39 form a closed circuit connected to the attachment point 35 of the cabin by shackles 49 pivotally mounted on the same pin. During its upward movement (FIG. 4) the cabin rises by taking first of all a vertical path then it follows the transition curve of the arc of the supporting structure while remaining horizontal. Movement of the cabin over the arc will be better understood by considering the triangle A,B,C whose apices represent respectively the axis 19 of the downstream bogies, the axis 19 of the upstream bogies and the axis of the lower downstream rollers. Starting with a curve privileging the movement of the cabin in so far as the acceleration and wear of the rollers in play are concerned, chosen for the inner rail 31 considering a given dimensioning of the triangle (related to the geometry of the cabin), paths are plotted over the arc from point A and from point C, the triangle A, B, C remaining horizontal during the whole of the movement. The profiles of the outer rail 33 and of the running rail 39 for the lower rollers 21 are thus readily inferred. The cabin has been shown in an intermediate position on the arc represented by the triangle A', B', C' and in a top position on the arc shown by the triangle A'', B'', C''.

A take-up cam 53 fixed to the top beam of the supporting structure receives the take-up rollers 27, then supporting the cabin when the downstream bogies 17 leave the upper end 37 of the outer rail 33. This take-up cam 53 thus ensure continuity of the movement of the cabin. The length of this essentially flat cam is such as to accommodate the approach of the take-up rollers 27 on said cam before interruption of the outer rail 33 and taking up of the downstream bogie 17 by the inner rail 31 for continuing the translational movement of the cabin over the main high part 11 of the supporting structure. At this state, rolling of the lower rollers 21 is no longer required and contact thereof with the corresponding running rail 39 disappears. The foregoing kinematic chain of the movement of the cabin for the arc seen from the lefthand side of the supporting structure may also apply to the righthand arc, in symmetrical relation. Thus, the cabin will move towards the downward section for stopping at the second station. The continuity of the movement of the cabin on approaching the righthand arc is provided as before by second take-up rollers 55 on cam 57. The position of these rollers 55 is chosen offset to the first take-up rollers 27, so as not to interfere with these latter.

The supporting rails 31, 33 and 39 are formed from metal tubes with circular section fixed and adjusted in width along the beam of the supporting structure by means of adjustable fixing lugs, the rollers of the bogies comprising a complementary resilient covering, promoting running of the cam over the supporting rails. The beam may comprise transverse brackets 59 spaced evenly apart over its length. These brackets 59 ensure the lateral rigidity thereof. As a variant, the continuity of the movement of the cabin at the top of the arc of the structure may be provided by using double roller bogies with offset inner and outer rails, an intermediate rail providing the transition between these latter. It is also possible to envisage other forms for the supporting structure, for example slanting uprights, arcs with hyberbolic curvature, a main median part slightly rounded, etc.

The supporting structure may further be associated with several other equivalent structures so as to allow the movement of two or more elevator cabins and thus to provide the transport for a large number of passengers. An important variant consists of in designing a disymmetrical supporting structure comprising either two stations at different altitudes, or a single vertical part followed by a horizontal part, the driving machinery in this latter case being situated at the end of the horizontal path.

Thus, the present invention provides an efficient and reliable means for crossing town streets, particularly for pedestrians.

I claim:

1. A traversing elevator for ferrying pedestrians over town streets (9), railroads, water ways, work sites, or other obstacles, of the type shuttling over an arc-shaped support structure (3) astride said obstacle (12) comprising at least one cabin (1) and two stations (13) accessible to the pedestrians, the movement of the cabin being provided by a traction cable (43) with electric motor propulsion, wherein the cabin is vertically and horizontally supported on tracks that maintain the cabin in a fixed orientation throughout its movement across the obstacle and also guide the cabin vertically and horizontally above and over the obstacle characterized by:

four roller trolleys (17) situated substantially at the ends of the edges of the cabin (1) in a substantially median horizontal plane thereof, these trolleys (17) being pivotably mounted to the cabin with their pivoting axes (18) merged two-by-two;

two lower roller assemblies (21) situated under the cabin and disposed substantially in the two vertical planes of the pivoting axes (19) of said trolleys (17), these roller assemblies (21) being secured to the cabin by fixing triangles (23);

take-up rollers (27) fixed to the cabin, a fixing point (45) for the traction cable (43), situated under the cabin and on its vertical axis, said cable (43) running on pulleys (41) and forming a looped circuit closed at the fixing point (45) of the cabin by two shackles (49) pivoting on the same pin;

an element for guiding the roller trolleys (17) when running fixed to the supporting structure (3) formed on one side of the structure by an outer rail (33) receiving the downstream roller trolleys and an inner rail (31) integral with a check rail (35) receiving the upstream roller trolleys, these rails comprising successively a vertical rising part extending from side station (13) and a curved transitional part, the outer rail (33) being connected by its upper end (37) to the check rail (35) and the inner rail (31) being extended as far as the second station (13);

at least one running rail (39) for said upstream lower rollers (21) of the cabin comprising a vertical rising part followed by a curved transitional part; and at least one take-up cam (53) disposed at the level of the bottom of the beam of the supporting structure (3) and projecting over a small length outwardly of the arc of the beam, said cam (53) being adapted for receiving said take-up rollers (27) in running relation, so as to support the cabin (1) when the downstream roller trolleys (17) leave the upper end (37) of the outer rail (33).

2. Traversing elevator according to claim 1, characterized in that the roller trolleys (17) are bogies.

3. Traversing elevator according to claim 1, characterized in that the roller trolleys (17) each comprise several successive roller trains.

4. Traversing elevator according to claim 1, characterized in that the lower roller assemblies (21) are formed from pairs of rollers.

5. Traversing elevator according to claim 1, characterized in that the the rollers of the roller trolley (17), the lower rollers (21) and the take-up rollers (27) have the same diameter.

6. Traversing elevator according to claim 1, characterized in that the lower roller assemblies (21) are disposed in proximity and on each side of the pulleys (41) of the traction cable (43), symmetrically with respect to the median longitudinal plane of the elevator cabin.

7. Traversing elevator according to claim 1, characterized in that the transition curvature of the inner (31), outer (33) and running rails (39) of the lower rollers is circular.

8. Traversing elevator according to claim 7, characterized in that the radius of this transition curvature is close to three meters.

9. Traversing elevator according to claim 1, characterized in that the main median part of the inner rail (31) is horizontal and rectilinear.

10. Traversing elevator according to claim 9, characterized in that the median part of the inner rail (31) has a variable shape.

11. Traversing elevator according to claim 1, characterized in that the continuity of the movement of the cabin at the top of the arc of the supporting structure (3) is provided by double roller trolleys (17) running over offset outer (33) and inner (31) rails, an intermediate rail providing the connection between these latter.

12. Traversing elevator according to claim 1, characterized in that, for connecting two levels of different altitudes together, the inner rail (31) only comprises a single vertical part followed by a horizontal part, the drive machinery being situated at the end of the horizontal part.

13. Traversing elevator according to claim 1, characterized in that the outer (33), inner (31) and running (39) rails of the lower rollers (21) are made from metal tubes of circular section fixed and fitted to the supporting structure (3) by adjustable fixing lugs.

14. A traversing elevator for ferrying passengers between two horizontally-displaced stations (13) over an obstacle (12) comprising:

an arc-shaped supporting structure (3) having a vertical portion (7) at each station, an arcuate portion (5) connected to the top of each vertical portion, and a horizontal portion (11) connected between the two arcuate portions; and a cable-drawn cabin (1) disposed upon the structure; characterized in that:

trolley rollers (17) are fixed to either side of the cabin approximately at the midpoint of the vertical dimension of the cabin;

lower rollers (21) are fixed to either side of the cabin approximately at the base thereof;

each vertical portion of the support structure comprises two rails spaced apart horizontally by a distance corresponding to the width of the cabin;

the horizontal portion of the support structure comprises two rails spaced apart vertically by a distance corresponding to the vertical distance between the trolley rollers and the lower rollers;

the trolley rollers of one side of the cabin cooperate with one of the rails of the vertical portion, the trolley rollers of the other side of the cabin cooperate with the other rail of the vertical portion, and one of the lower rollers cooperates with one of the rails of the vertical portion, the trolley rollers of the other side of the cabin cooperate with the other rail of the vertical portion, and one of the lower rollers cooperates with one of the rails of the vertical portion of the support structure to form a three-point suspension for the cabin when the cabin is located at a vertical portion of the support structure;

the trolley rollers of both sides of the cabin cooperate with the upper rail of the horizontal portion and the lower rollers cooperate with the lower rail of the horizontal portion of the support structure to form a four-point suspension for the cabin when the cabin is located at the horizontal portion of the support structure.

15. Traversing elevator according to claim 14, characterized in that:

one of the rails of the vertical portion of the support structure is constructed to contact diametrically opposed portions of the trolley roller and the lower roller cooperating therewith.

16. Traversing elevator according to claim 14, characterized in that:

in the arcuate portion of the support structure both of the spaced-apart rails of the vertical portion curve towards the upper rail of the horizontal portion.

17. Traversing elevator according to claim 14, characterized in that in the arcuate portion of the support structure the lower rail of the horizontal portion curves towards the rail of the vertical portion that is disposed towards the other station.

* * * * *

UNITED STATES PATENT AND TRADEMARK OFFICE

CERTIFICATE OF CORRECTION

PATENT NO. : 4,821,845

DATED : April 18, 1989

INVENTOR(S) : Guy DeViaris

It is certified that error appears in the above-identified patent and that said Letters Patent is hereby corrected as shown below:

In the Abstract, line 4, "trollys" should read --trolleys--.

In Claim 1, line 55, "side" should read --said--.

In Claim 5, column 5, line 12 cancel first occurrence of "the".

Signed and Sealed this

Ninth Day of January, 1990

*Attest:*

JEFFREY M. SAMUELS

*Attesting Officer*

*Acting Commissioner of Patents and Trademarks*